US005783954A

United States Patent [19]

Koifman et al.

[11] Patent Number: 5,783,954

[45] Date of Patent: Jul. 21, 1998

[54] LINEAR VOLTAGE-TO-CURRENT CONVERTER

[75] Inventors: Vladimir Koifman, Rishon-Lezion; Yachin Afek, Kfar Saba, both of Israel

[73] Assignee: Motorola, Inc., Schaumburg, Ill.

[21] Appl. No.: 695,929

[22] Filed: Aug. 12, 1996

[51] Int. Cl.[6] ..... G05F 1/10

[52] U.S. Cl. ..... 327/103; 327/355

[58] Field of Search ..... 327/103, 355, 327/356, 361

[56] References Cited

U.S. PATENT DOCUMENTS

| | | | |
|---|---|---|---|
| 4,636,663 | 1/1987 | Jongepier et al. | 327/355 |
| 5,151,625 | 9/1992 | Zarabadi et al. | 327/103 |
| 5,187,682 | 2/1993 | Kimura | 327/356 |
| 5,438,296 | 8/1995 | Kimura | 327/356 |
| 5,469,092 | 11/1995 | Itakura | 327/103 |
| 5,576,653 | 11/1996 | Kimura | 327/356 |
| 5,581,210 | 12/1996 | Kimura | 327/355 |
| 5,650,743 | 7/1997 | Bien et al. | 327/361 |
| 5,666,083 | 9/1997 | Myers et al. | 327/103 |

OTHER PUBLICATIONS

Ismail, M., Fiez, T.: Analog VLSI Signal and Information Processing, McGraw-Hill, 1994, ISBN 0-07-032386-0, chapter 3.3.

Silva-Martinez, J.: High-Performance CMOS Continuous-Time Filters, Kluwer Academic Publishers, ISBN 0-7923-9339-2., Chapter 2.

*Primary Examiner*—Terry Cunningham
*Attorney, Agent, or Firm*—Robert M. Handy

[57] ABSTRACT

A linear voltage-to-current converter (VIC) 100 for converting a differential input voltage $V_D$ into a differential output current ID is provided. The VIC (100) comprises a main stage (20) and a correction stage (30) having two FET each. Every stage is fed by a separate current source (150, 160). In two nodes (174, 172) the output currents of the stages are added. The scale factors $k_1$ and $k_3$ of the FET are coordinated so that distortions are reduced.

7 Claims, 5 Drawing Sheets

100

LINEAR VOLTAGE-TO-CURRENT CONVERTER

FIELD OF THE INVENTION

This invention relates to circuits for converting voltages to currents (voltage-to-current converter, VIC), especially to VICs having a linear transfer function.

BACKGROUND OF THE INVENTION

Voltage-to-current converters (VIC) are widely used in many devices like continuous-time analog-to-digital converters (ADC), filters, and others. The properties of the VIC influence the overall performance of the devices. The linearity of the device is usually limited by the VIC.

The transfer function of the VIC, and in general that of any circuits, is limited by intrinsic nonlinearities of the components, especially that of transistors. The relation between the input signal $S_{in}$ and the output signal $S_{out}$ of a converter is not linear, but can be expressed by a polynomial:

$$S_{out}=k_1*S_{in}+k_2*S_{in}^2+k_3*S_{in}^3+ \quad (1)$$

Therefore, a simple sinusoidal input signal $S_{in}$ having the frequency $f_1$ is transformed into an output signal $S_{out}$ having not only the fundamental frequency $f_1$ but also harmonics like $f_3=3*f_1$.

The higher frequency parts of $S_{out}$ are influenced by the Total Harmonic Distortion (THD). An input signal $S_{in}$ having multiple frequencies is transferred into an output signal $S_{out}$ containing also sum and difference frequencies. That can lead to intermodulation distortions. In integrated circuits, the use of resistors as converter components is limited by their required chip area and power dissipation. Therefore, a VIC to be used in integrated circuits should preferably be made up of transistors only.

For the application of VIC and for prior art designs, the following references are useful:

[1] Ismail, M., Fiez, T.: Analog VLSI Signal and Information Processing, McGraw-Hill, 1994, ISBN 0-07-032386-0; and

[2] Silva-Martinez, J.: High-Performance CMOS Continuous-Time Filters, Kluwer Academic Publishers, ISBN 0-7923-9339-2.

The known prior art approaches are based on an idealized squared I-V-relation of field effect transistors (FET):

$$I=k_2*V^2. \quad (2)$$

Examples of prior art VIC are shown and explained in chapter 3.3. of [1] and chapter 2 of [2]. FIG. 1 shows a VIC representing the general prior art idea. The VIC comprises differential pair M1, M2 coupled between a differential load ($LOAD_1$, $LOAD_2$) and current sources $I_1$ and $I_2$. The input voltages $V_1$ and $V_2$ are applied at the control electrodes of the transistors. A linearization network is cross-coupled between control electrodes and main electrodes of the transistors. While such prior art solutions are useful, they continue to exhibit an undesirable amount of non-linearity, harmonic distortion and intermodulation distortion.

SUMMARY OF THE INVENTION

The objects of the invention are solved basically by applying the features laid down in the independent claims.

Further preferred embodiments of the invention are given in the dependent claims.

The invention provides a converter which reduces or overcomes the above mentioned disadvantages of the prior art.

In the voltage-to-current converter (VIC) of the present invention the input signal $S_{in}$ is simultaneously amplified by two stages. The resulting intermediate signals $S_{M1}$ and $S_{M2}$ are supplied to a node in which the output signal $S_{out}$ is composed. The intermediate signals $S_{M1}$ and $S_{M2}$ contain the linear signal component $S_L$ and non-linear distortions $S_N$. This nonlinear distortions $S_N$ can be compensated by the choice of coefficients of the elements (transistors) and by subtracting the intermediate signals $S_{M1}$ and $S_{M2}$ in the node.

The VIC according to a preferred embodiment of the invention comprises a main stage and a correction stage with two transistors each. The coefficients are transistor scale factors $k_1$, $k_3$ which depend on the transistor geometry. The coefficients can be optimized by simulation. The simulation shows that the THD can be reduced by 40 dB in comparison to a conventional single stage VIC.

DETAILED DESCRIPTION OF THE DRAWINGS

Figure 1:
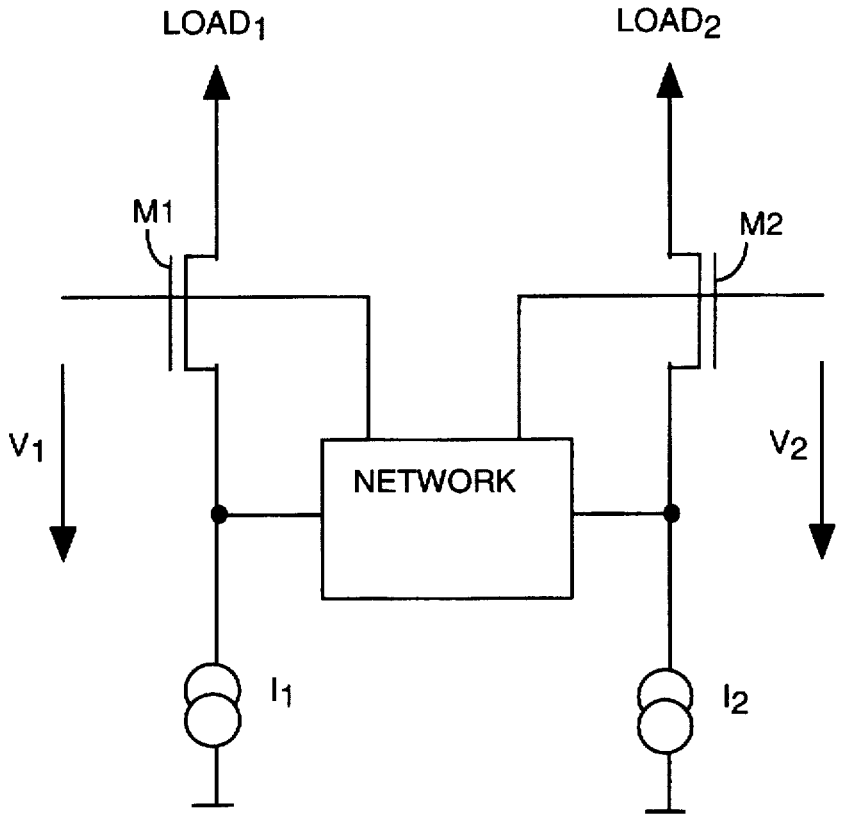
FIG. 1 PRIOR ART
FIG. 1 shows a simplified circuit diagram of a prior art voltage-to-current converter.
Figure 2:
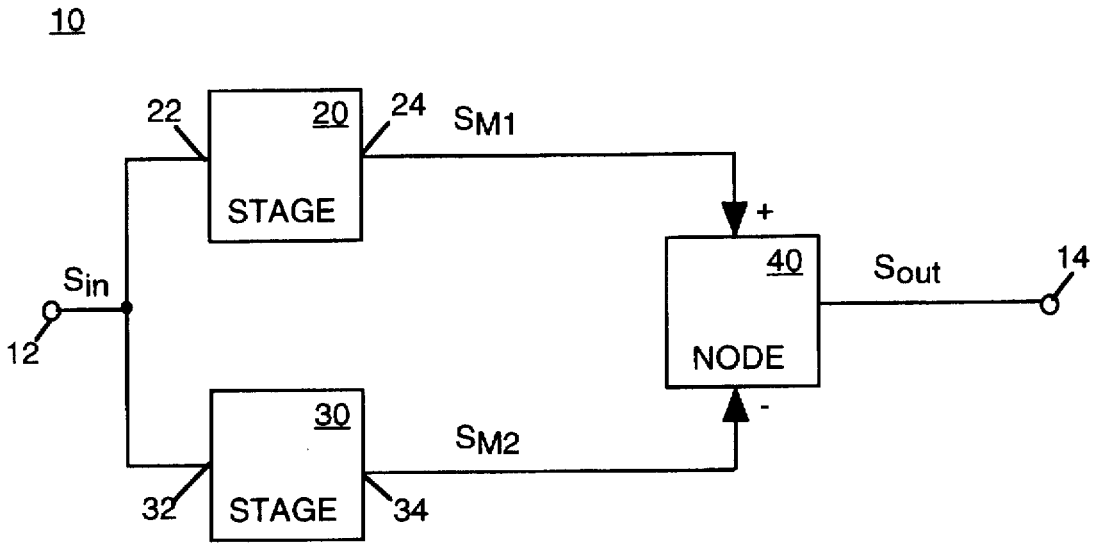
FIG. 2 shows a simplified block diagram of a converter according to the invention.

FIG. 2 shows a simplified schematic diagram of voltage-to-current converter 10 (hereinafter converter 10) according to the present invention. Converter 10 comprises amplifying stages 20 and 30, node 40, input terminal 12 and output terminal 14. Inputs 22, 32 of stages 20, 30 are coupled to input terminal 12. Outputs 24, 34 of stages 20, 30 are coupled to node 40 which is coupled to output terminal 14. A differential input signal $S_{in}$ is supplied to stages 20, 30. The intermediate signals $S_{M1}$, $S_{M2}$ are available at outputs 24, 34 of stages 20, 30, respectively. The intermediate signals $S_{M1}$, $S_{M2}$ are composed of $S_{M1}=S_{L1}+S_{N1}$ and $S_{M2}=S_{L2}+S_{N2}$ with $S_L$ as linear signal components and $S_N$ as the non-linear distortions. The intermediate signals $S_{M1}$, $S_{M2}$ are supplied to node 40 where an output signal $S_{out}$ is formed and sent to output terminal 14.

Output signal $S_{out}$ is the difference between $S_{M1}$ and $S_{M2}$, that is, $S_{out}=S_{M1}-S_{M2}$. The components of stages 20, 30 are selected in a way that non-linear distortions can be compensated so that $S_{N1}-S_{N2}=0$. The linear signal components are: $S_{L1}-S_{L2}>0$. Intermediate signal $S_{M2}$ can be considered as a correction signal. Stage 20 can also be called main stage. Stage 30 can be called correction stage.

The odd-order nonlinearities, such as third harmonics distortions, can be reduced. The converter has a fully differential and fully symmetrical structure so that even order distortions can be reduced.

An implementation of the invention will be explained in detail in connection with the following drawings.

Figure 3:
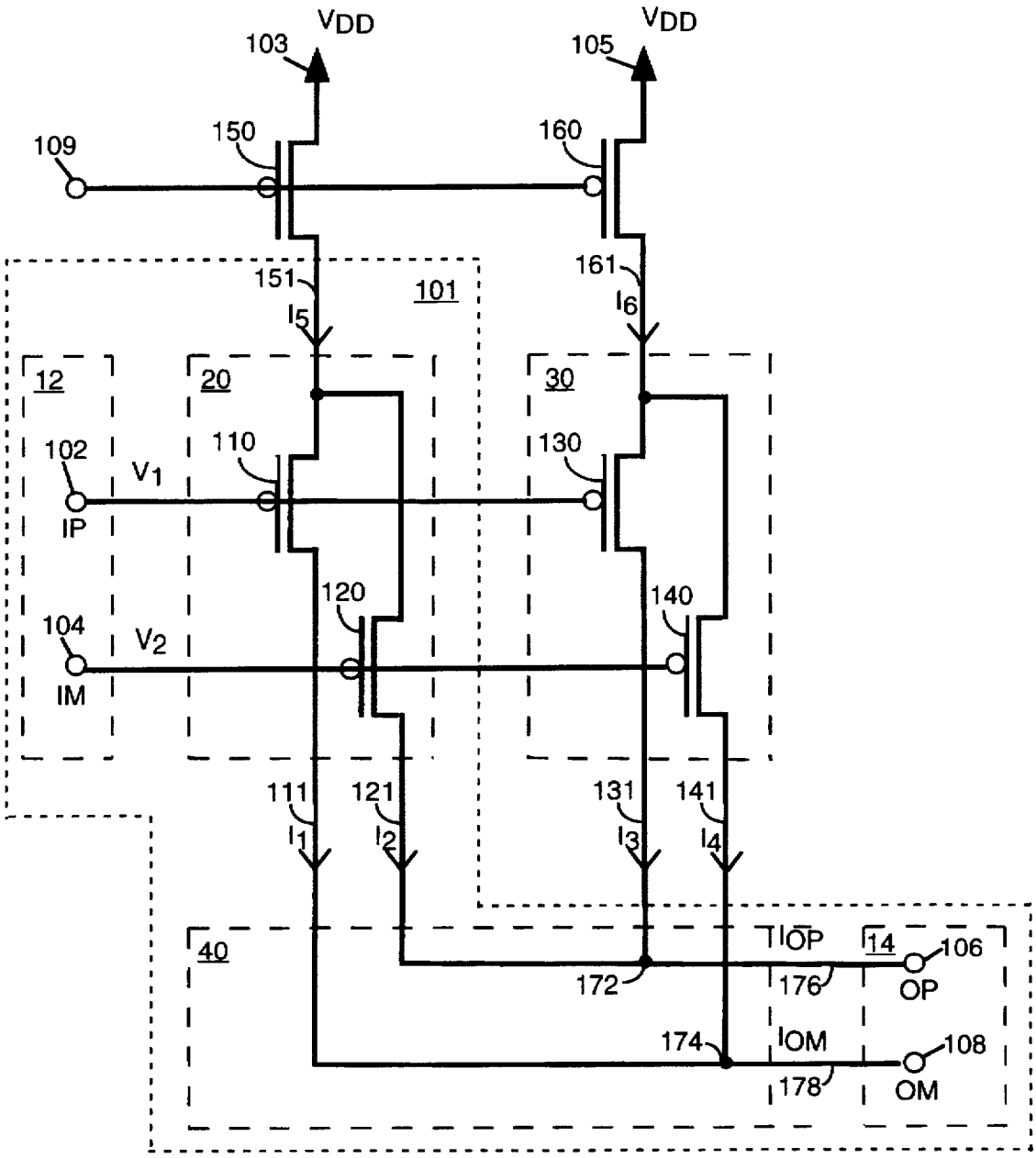
FIG. 3 shows a simplified circuit diagram of a voltage-to-current converter (VIC) in a preferred embodiment according to the invention.

FIG. 3 shows a simplified circuit diagram of voltage-to-current converter (VIC) 100 according to the present invention. VIC 100 comprises transistors 110, 120, 130, 140, current sources 150, 160, bias terminal 109, input terminals 102, 104, and output terminals 30 106, 108.

In further equations, indices i=1,2,3,4 refer to transistors 110, 120, 130, 140, respectively. It is assumed that all transistors are p-channel type field effect transistors (FETs). The p-channel type is symbolized by a circle at the transistor gates. Each transistor has a first main electrode (e.g., source), a second main electrode (e.g., drain) and a control electrode (e.g., gate). That is convenient for the explanation, but not necessary for the invention. For example, and not intended to be limiting, n-channel FETs and bipolar transistors can also be used.

In FIG. 3, the correspondence to FIG. 2 is indicated by dashed blocks representing input terminal 12, output terminal 14, stages 20, 30, and node 40.

Transistors 110, 120 form stage 20, transistors 130, 140 form stage 30, and nodes 172, 174 form node 40. Input terminals 102, 104 corresponds to input terminal 12. Output terminals 106, 108 corresponds to output terminal 14.

In the example of FIG. 3, current sources 150, 160 are implemented by p-channel-type FETs which are biased from bias terminal 109. Current sources 150, 160 provide currents $I_5$, $I_6$ indicated by reference numerals 151, 161. $I_5$, $I_6$ can be different in order to get different transconductances of coupled transistors 110, 120 and 130, 140.

The common sources of transistors 110, 120 are coupled via current source 150 to a first supply terminal 103. Similarly, the sources of transistors 130, 140 are coupled to second supply terminal 105 via current source 160. Supply terminals 103, 105 are indicated by an upward pointing arrow. It is convenient, that supply terminal 103 and supply terminal 105 are identical and provide the same supply voltage $V_{DD}$.

The common gates of transistor 110, 130 are coupled to input terminal 102 (IP) for receiving input voltage $V_1$. The common gates of transistor 120, 140 are coupled to input terminal 104 (IM) for receiving input voltage $V_2$. For convenience of explanation, input voltages $V_1$ and $V_2$ are related to ground. A differential input voltage $V_D$ is defined as $V_1-V_2$.

The common drains of transistors 110, 140 are coupled via node 174 to output terminal 108 (OM). Similarly, the common drains of transistors 120, 130 are coupled via node 172 to output terminal 106 (OP).

Input voltages $V_1$ and $V_2$ control transistors 110, 120, 130, 140 which divide currents $I_5$, $I_6$ into drain currents $I_1$, $I_2$, $I_3$, and $I_4$. The drain currents are summed in nodes 172, 174 to output currents $I_{OP}=I_2+I_3$ and $I_{OM}=I_1+I_4$. $I_{OP}$ and $I_{OM}$ are indicated by reference numerals 176, 178. A differential output current $I_D$ is defined as $I_D=I_{OP}-I_{OM}$.

In comparison to FIG. 2, input voltages $V_1$, $V_2$, ($V_D$) correspond to input signal $S_{in}$, drain currents $I_1$, $I_2$ to $S_{M1}$, $I_3$, $I_4$ to $S_{M2}$, and $I_{OP}$, $I_{OM}$ to output signal $S_{our}$ The compensation of non-linear distortions is explained in the following: Supposing every transistor with the index i has a nonlinear I-V-transfer function:

$$I=k_{1i}*V_{SGI}+k_{2i}*V_{SGI}^2+k_{3i}*V_{SGi}^3 \quad (3)$$

with $I_i$ as the drain current and $V_{GSi}$ as source-gate voltage. The linear scale factor $k_{1i}$ and the third order scale factor $k_3$ i depend particularly on the geometry of the FET.

This proposed cubic equation (3) corresponds better to recent improvements in CMOS technology than the above mentioned idealized squared I-V-transfer function of equation (2). Equation (3) is especially suitable for CMOS transistors with low-doped-drains (LDD), non-uniform channel doping, etc. For such transistors, the quadratic scale factor $k_{2i}$ can be neglected.

By applying equation (3) to transistors 110, 140, output current $I_{OM}$ can be calculated as:

$$I_{OM}=I_1+I_4 \quad (4)$$

$$I_{OM}=k_{11}*V_{SG1}+k_{31}*V_{SG1}^3+k_{14}*V_{SG4}+k_{34}*V_{SG4}^3 \quad (5)$$

Changes of $I_{OM}$ can be calculated accordingly:

$$\Delta I_{OM}=\Delta I_1+\Delta I_4 \quad (6)$$

$$\Delta I_{OM}=k_{11}*\Delta V_{SG1}+k_{31}*\Delta V_{SG1}+k_{14}*\Delta V_{SG4}+k_{34}*\Delta V_{SG4}^3 \quad (7)$$

Suppose, input voltage $V_1$ changes by $\Delta V$ and $V_2$ changes by $-\Delta V$. As will be explained, $\Delta V$ can be positive or negative. The source-gate-voltages $V_{SG1}$ and $V_{SG4}$ of transistors 110 and 140 change as $\Delta V_{SG1}=-\Delta V$ and $\Delta V_{SG4}=\Delta V$. Equation (7) can be rewritten as:

$$\Delta I_{OM}=k_{11}*(-\Delta V)+k_{31}*(-\Delta V)^3+k_{14}*\Delta V+k_{34}*\Delta V^3 \quad (8)$$

$$\Delta I_{OM}=\Delta V*(k_{14}-k_{11})+\Delta V^3*(k_{34}-k_{31}) \quad (9)$$

Equation (9) is an odd function. First, assuming a positive $\Delta V$. Input voltage $V_1$ is increased by the amount $|\Delta V|$ of $\Delta V$ and $V_2$ is decreased by the amount $|\Delta V|$ of $\Delta V$. That means an increase of the differential input voltage $V_D=V_1-V_2$ by $2*|\Delta V|$. $I_{OM}$ is increased by:

$$|\Delta I_{OM}|=|\Delta V|*(k_{14}-k_{11})+|\Delta V|^3*(k_{34}-k_{31}) \quad (10)$$

Second, assuming a negative $\Delta V$. Input voltage $V_1$ is decreased by the amount $|\Delta V|$ of $\Delta V$ and $V_2$ is increased by the amount $|\Delta V|$ of $\Delta V$. That means an decrease of the differential input voltage $V_D=V_1-V_2$ by $2*|\Delta V|$. $I_{OM}$ is decreased by:

$$|\Delta I_{OM}|=|\Delta V|*(k_{11}-k_{14})+|\Delta V|^3*(k_{31}-k_{34}). \quad (11)$$

The sum $I_1+I_2$ is not influenced by the $\Delta V$-change.

In equation (9), the first term includes the linear component of $I_{OM}$. The second term includes the non-linear component. When the scale factors $k_{31}$ and $k_{34}$ are similar or even equal, the second term in equation (9) can be neglected, and the nonlinear distortions can be reduced or compensated.

It can be seen from the first term of equation (9), that the linear amplification is reduced compared to a single FET-stage. But that can be taken into account in the amplifier design.

The other output current $I_{OP}$ can be calculated in the same way as it was shown for output current $I_{OM}$.

The scale factors $k_{ji}$ are determined by the geometry of the transistors, as for example, the transistor aspect ratio (channel width/channel length) and magnitudes. Persons of skill in the art understand how to design the size, shape and aspect ratio of transistors in order to obtain transistors scale factors of different magnitudes so that the conditions for elimination the distortion terms are satisfied.

As above mentioned, a differential output current $I_D$ is defined as $I_D=I_{OP}-I_{OM}$. That can be written as:

$$I_D=I_2+I_3-(I_1+I_4) \quad (12)$$

$$I_D=(I_2-I_1)+(I_3-I_4) \quad (13)$$

$$I_D=I_{DM}+I_{DC} \quad (14)$$

$I_{DM}$ is the main current for a main differential pair comprising transistor 110, 120. $I_{DC}$ is the correction current for a correction differential pair of transistor 130, 140.

Figure 4:
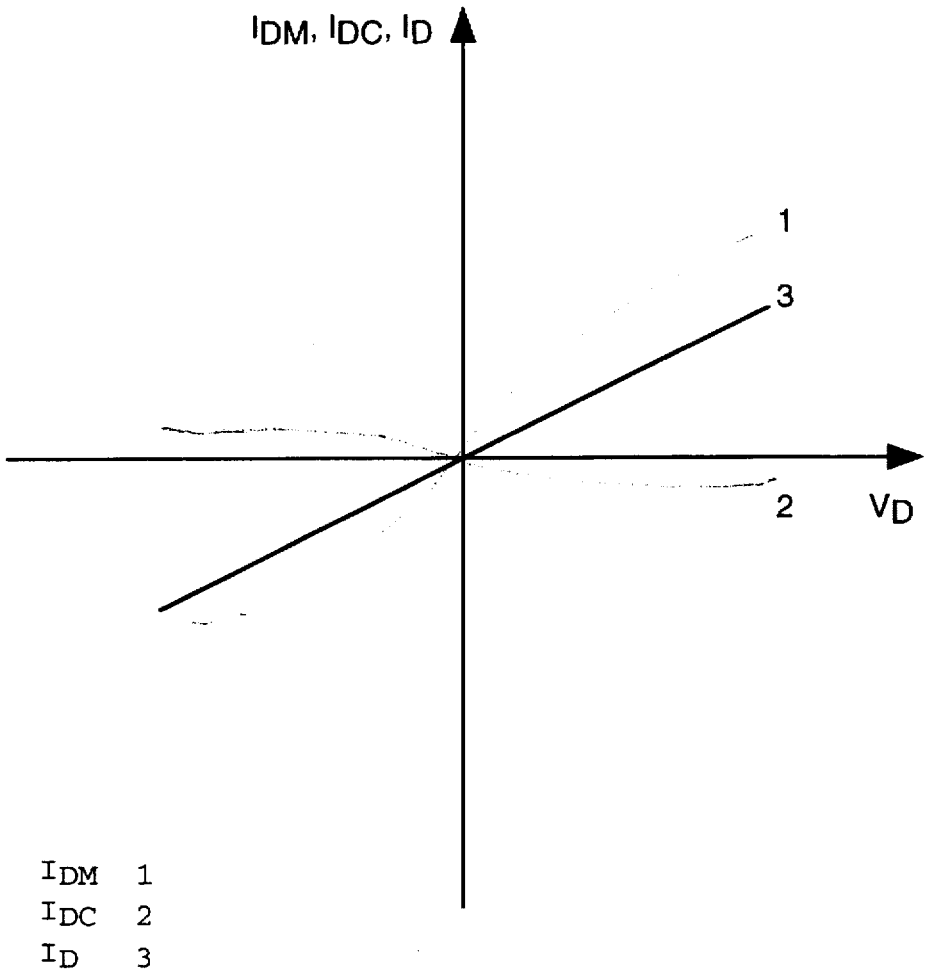
FIG. 4 shows a voltage-current diagram illustrating the compensation of non-linear distortions by the converter of the present invention.

FIG. 4 shows a current-voltage-diagram. The differential input voltage $V_D$ is given on the horizontal axis. The currents $I_{DM}$, $I_{DC}$, and $I_D$ are given on the vertical axis. Graphs 1, 2, and 3 show the dependencies of currents $I_{DM}$, $I_{DC}$, and $I_D$ on $V_D$. It can be seen that nonlinearities which are present in $I_{DM}$ and $I_{DC}$ are not present in $I_D$.

To obtain a linear V-I-transfer function, the geometry of the transistors can be optimized by simulation, using any of the device simulators well known in the art, as for example, SPICE. Comparing to prior art, the total harmonic distortion (THD) is much reduced.

Figure 5:
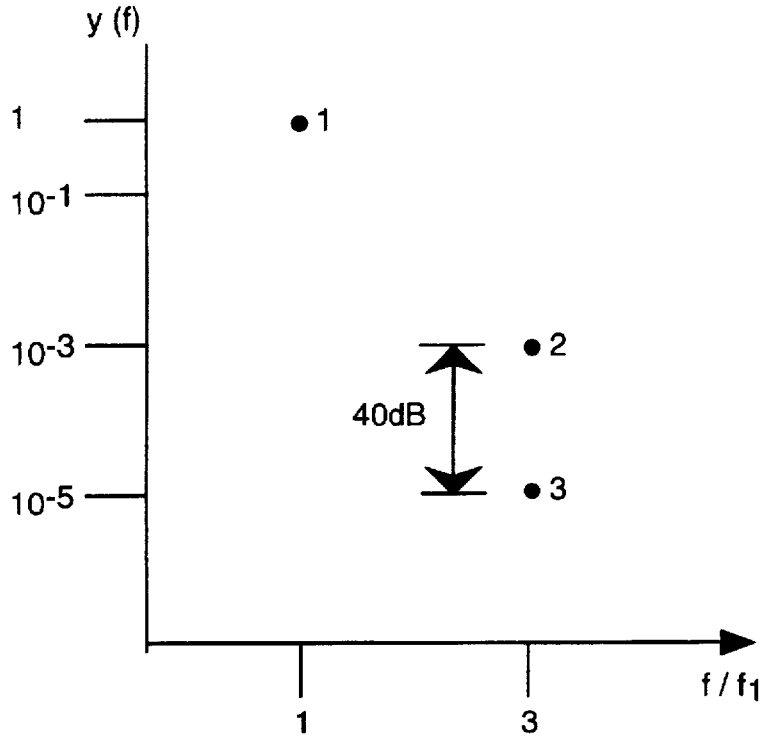
FIG. 5 shows a diagram of a comparison of the VIC of FIG. 2 and a single stage VIC, as determined by Fourier analysis.

FIG. 5 is a diagram showing the results of a SPICE simulation with Fourier analysis.

A differential input voltage $V_D$ having the base frequency $f_1$ was applied a) to single stage VIC 101 shown in FIG. 3 (dashed line) without stage 30 of the present invention, and b) to VIC 100 of the present invention.

Single stage VIC 101 of case a) was a modified VIC 100 in which transistors 130, 140 had been left out.

The differential output current $I_D$ was calculated and Fourier analyzed. The vertical axis shows the normalized ratio $Y(f)=(I_D(f_1)/I_D(f)$ of $I_D$ at different frequencies related to the base frequency $f_1$. The horizontal axis shows the frequency ratio $f/f_1$.

Point 1 applies to both converters. At the base frequency $f_1$ there was no distortion. Point 2 applies to single stage VIC 101. Point 3 applies to VIC 100 of the present invention. The ratio between point 3 and point 2 is $10^{-2}$. The means that VIC 100 of the invention has 40 dB smaller distortion than single stage VIC 101.

The total harmonic distortion is calculated as $$T_{HD}=100\%*(Y_2^2+y_3^2+y_4^2+y_5^2+)^{1/2} \quad (15)$$

where $y_i$ symbolizes y(f) for frequencies $f=i*f_1$. For the third harmonics at frequencies $f_3=f_1*3$ the ratio y is the greatest. So the other components can be neglected and the THD value is approximately $THD=100\%*y_3$. The simulation resulted in a THD value of around 0.01% (point 3) which is 100 times or 40 dB better than in the prior art (point 2).

The converter according to the present invention is especially useful at frequencies $f_1$ up to 10 MHz, but higher or lower frequencies can also be used.

While the above circuit descriptions illustrate p-channel type FET as part of a CMOS circuit, the teachings of this disclosure can be advantageously applied to other device types and semiconductor process technologies. While the invention has been described with respect to the embodiments set forth above, the invention is not necessarily limited to these embodiments. For example, a person skilled in the art could "invert" the circuit by interchanging the p-channel type by n-channel type transistors. Numerous other transistor configurations can be implemented which will provide a circuit having analogous operation. Accordingly, other embodiments, variations, and improvements not described herein are intended to be included in the scope of the invention, which is defined by the following claims.

We claim:

1. A voltage-to-current converter (VIC) comprising:

a first transistor, a second transistor, a third transistor, and a fourth transistor, each having a first main electrode a second main electrode, and a control electrode, said first transistor and said second transistor each having the first main electrode coupled to a first supply terminal, said third transistor and said fourth transistor each having the first main electrode coupled to a second supply terminal, said first transistor and said fourth transistor having the second main electrode coupled to a first node, said second transistor and said third transistor having the second main electrode coupled to a second node, wherein each of said transistors has a current-voltage characteristic substantially described by the equation, $$I_i=K_{1i}*V_{SGi}+k_{2i}*V_{SGi}^2+k_{3i}*V_{SGi}^3$$

where $V_{SGi}$ is an input voltage of the $i^{th}$ transistor and $I_i$ is an output current through the $i^{th}$ transistor, and wherein subscript i takes on values i=1, 2, 3, 4 for the first, second, third and fourth transistors, respectively, and wherein coefficient $k_{2i}$ is substantially equal to zero and wherein coefficients $k_{1i}$ and $k_{3i}$ have values such that $|I_2-I_1|$ is greater than zero and $I_3-I_4$ is substantially zero;

a first input terminal coupled to the control electrodes of said first transistor and said third transistor;

a second input terminal coupled to the control electrode of said second transistor and said fourth transistor; and a first output terminal coupled to said first node and a second output terminal coupled to said second node.

2. A voltage-to-current converter (VIC) as of claim 1 where said first transistor and said second transistor are coupled to said first supply terminal via a first current source and said third transistor and said fourth transistor are coupled to said second supply terminal via a second current source.

3. A voltage-to-current converter (VIC) as of claim 1 where said first supply terminal and said second supply terminal are common.

4. A voltage-to-current converter (VIC) as of claim 1 where said first transistor, said second transistor, said third transistor, and said fourth transistor are field effect transistors (FETs) having first order coefficients k11, k12, k13, k14, respectively, and third order coefficients k31, k32, k33, k34, respectively, and wherein coefficients k31 and k34 are almost equal and coefficients k31 and k33 are almost equal, and wherein coefficients k11 and k14 are substantially not equal and coefficients k12 and k13 are substantially not equal.

5. A voltage-to-current converter (VIC) as in claim 1 where said first transistor, said second transistor, said third transistor, and said fourth transistor are p-channel type FETs.

6. A voltage-to-current converter (VIC) as in claim 2 where said first current source and said second current sources provide currents having different values.

7. A converter for receiving an input signal $S_{in}$ and providing an output signal $S_{out}$, comprising:

a first stage for receiving the input signal $S_{in}$ and supplying a first intermediate signal $S_{M1}$, said first stage having a polynomial transfer characteristic so that the first intermediate signal $S_{M1}$ has linear and higher order terms, wherein a magnitude of any quadratic term is negligible compared to magnitudes of linear and cubic terms;

a second stage for receiving the input signal $S_{in}$ and supplying a second intermediate signal $S_{M2}$, said second stage having a polynomial transfer characteristic so that the second intermediate signal $S_{M2}$ has linear and higher order terms wherein a magnitude of any quadratic term is negligible compared to magnitudes of linear and cubic terms, wherein the linear term of the second intermediate signal $S_{M2}$ is different from the linear term of the first intermediate signal $S_{M1}$, and the cubic term of the second intermediate signal $S_{M2}$ is substantially equal to the cubic term of the first intermediate signal $S_{M1}$; and a node for combining the first intermediate signal $S_{M1}$ and the second intermediate signal $S_{M2}$ so as to provide an output signal $S_{out}$, whereby the cubic terms of the first intermediate signal $S_{M1}$ and the second intermediate signal $S_{M2}$ substantially cancel each other so that the output signal $S_{out}$ is formed substantially by the linear terms of the first intermediate signal $S_{M1}$ and the second intermediate signal $S_{M2}$, thus reducing nonlinear distortion of said converter.

* * * * *